United States Patent [19]

Kuelzer

[11] Patent Number: 4,491,430

[45] Date of Patent: Jan. 1, 1985

[54] RIBBON MONITOR FOR RIBBON CASSETTE

[75] Inventor: Peter Kuelzer, Wessling, Fed. Rep. of Germany

[73] Assignee: Siemens Aktiengesellschaft, Berlin & Munich, Fed. Rep. of Germany

[21] Appl. No.: 478,170

[22] Filed: Mar. 23, 1983

[30] Foreign Application Priority Data

Apr. 20, 1982 [DE] Fed. Rep. of Germany ..... 3214548

[51] Int. Cl.[3] ..... B41J 35/28

[52] U.S. Cl. ..... 400/208; 400/249; 242/199

[58] Field of Search ..... 400/249, 207, 208, 208.1, 400/236, 706, 708; 226/11, 45; 242/197, 198, 199, 200; 116/67 A; 250/559, 560, 561

[56] References Cited

U.S. PATENT DOCUMENTS 4,213,575 7/1980 Firth et al. ..... 242/57
4,406,553 9/1983 Nally et al. ..... 400/208
4,406,554 9/1983 Dreinhoff et al. ..... 400/249

FOREIGN PATENT DOCUMENTS 2746059 4/1979 Fed. Rep. of Germany ..... 400/249
3045461 6/1982 Fed. Rep. of Germany .
1577666 10/1980 United Kingdom .

*Primary Examiner*—Edgar S. Burr
*Assistant Examiner*—Charles A. Pearson
*Attorney, Agent, or Firm*—Hill, Van Santen, Steadman & Simpson

[57] ABSTRACT

A ribbon cassette includes an impeller actuating element mounted at the end of a ribbon guide roller. A feed reel, on which the ribbon is mounted, rotates the guide roller, by means of the ribbon, and is mounted so as to be displaceable relative to the guide roller. The ribbon continues to rotate the guide roller as it is transported from the reel. When the remaining ribbon is at a specific length, the core of the reel halts the impeller, thereby discontinuing signals in a scanning device. Nevertheless the remaining ribbon can still be unreeled from the feed reel. The scanning of the movement of the impeller can be carried out by using a sensing mandrel attached to a spring member.

5 Claims, 3 Drawing Figures

RIBBON MONITOR FOR RIBBON CASSETTE

FIELD OF THE INVENTION

The present invention relates to a device for monitoring the transport of a ribbon, and more particularly for a ribbon in a ribbon cassette used in a typewriter, printer or the like.

THE PRIOR ART

In printers such as used with typewriters and business machines, ribbon cassettes are typically employed. It is desirable to monitor the transport of the ribbon in order to suppress operation of the printer in the event that the ribbon becomes torn, or for some other reason fails to transport properly. For this purpose it is generally known to scan the ribbon directly, which requires special apparatus for that purpose to indicate the end of the ribbon in advance. Such scanning devices are generally of elaborate construction.

BRIEF DESCRIPTION OF THE INVENTION

A principle object of the present invention is to provide a device for monitoring the transportation of a strip-like carrier mounted in a cassette such as a ribbon, which is of simple design and which facilitates indication of the ribbon end without the addition of expensive extra equipment.

This object is realized in the present invention by employing a guide roller provided with an impeller with means for mechanically or optically scanning the position thereof, for monitoring the transport of the ribbon in a particularly simple manner.

The feed reel, on which the ribbon is mounted, rotates the guide roller, by means of the ribbon, and is mounted so as to be displaceable relative to the guide roller. The ribbon continues to rotate the guide roller as it is transported from the reel. When the remaining ribbon is at a specific length, the core of the reel halts the impeller, thereby discontinuing the signals from the scanning device. Nevertheless the remaining ribbon can still be unreeled from the feed reel.

The scanning of the movement of the impeller can be carried out in a simple mechanical fashion, using a sensing mandrel, or through the use of a reflection scanner in the form of an opto-electronic sensor.

These and other objects and advantages of the present invention will become manifest by an inspection of the following description and the accompanying drawings.

BRIEF DESCRIPTION OF THE DRAWINGS

Reference will now be made to the accompanying drawings in which.

DESCRIPTION OF THE PREFERRED EMBODIMENT

Figure 1:
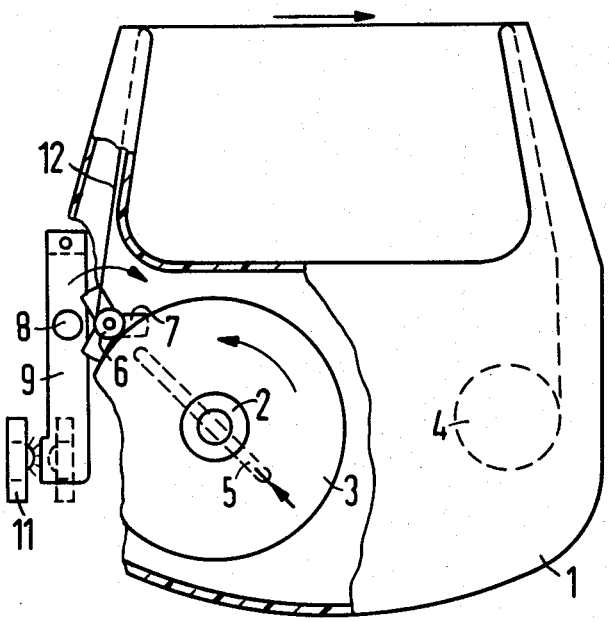
FIG. 1 is a plan view, partly in section, showing the transport monitoring device.

Referring to the drawings, a ribbon cassette 1 contains a feed reel having a feed winding 3 supported on a core 2, and a take-up reel 4. The feed reel is mounted so as to be displaceable in slots 5 provided in the cassette housing, and the ribbon passes over a guide roller 6. An electric motor (not shown) serves to drive the take-up reel 4, and during the printing operation the ribbon is unreeled from the feed winding 3, passes over the guide roller 6 and, after passing through the printing area, is taken up by the take-up reel 4.

An impeller 7 is connected to the guide roller 6 and comprises three actuating elements or vanes which rotate with the guide roller 6. A scanning device, which serves to scan the movement of the actuating elements, and to convert such movement into electrical signals, consists of a conical sensing mandrel 8 attached to a spring plate 9 which is supported on the base of the cassette housing. At its end, the spring plate 9 has a clip 10 which is adapted to the innerposed into the light signal path of an optical sensor 11.

Figure 2:
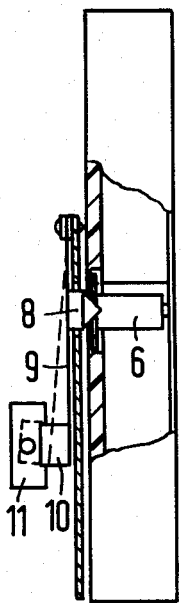
FIG. 2 is a side view of the apparatus of FIG. 1.

When movement of the ribbon from the feed reel to the take-up reel is functioning normally, powered by the electric motor connected to take-up reel 4, the ribbon moves and rotates the guide roller 6, together with its impeller 7. The vanes or actuating elements of impeller 7 slide over the conical surface of the sensing mandrel 8, forcing the mandrel 8 outwardly relative to the cassette, and thereby pivoting the clip 10 into the signal path of the optical sensor, by bending the spring 9. As shown in FIG. 2, the clip 10 moves from a nonblocking position shown in full line, to a blocking position shown in dashed lines. The signals which emanate from the optical sensor 11 comprise a series of pulses, having a pulse repetition rate which corresponds to the linear speed of the ribbon removed from the feed reel 3. If the movement of the ribbon is interrupted as a result of a tear in the ribbon, or jamming, no further actuation of the optical sensor 11 takes place, and a circuit connected to receive the signal from the sensor 11 recognizes a fault condition from a steady state (i.e. non pulse) condition of the optical sensor 11.

Figure 3:
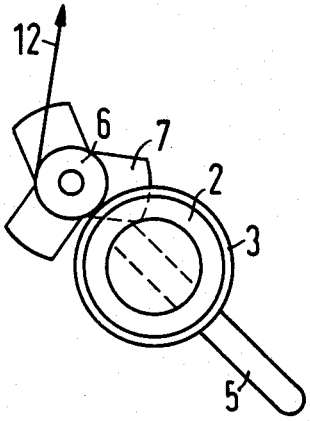
FIG. 3 is an illustration of a portion of the apparatus of FIG. 1, showing the conditions of engagement between the impeller and the feed reel near the end of the ribbon.

During the unwinding of the feed reel, the feed reel moves, together with its core 2, along the guide slot 5 of the cassette housing, under the influence of a spring (not shown). When the feed reel has unwound to a specific extent, in accordance with the illustration of FIG. 3, the core 2 of the feed reel approaches the position of the impeller 7, thereby blocking rotation of the impeller 7. This causes the pulses produced by the optical sensor 11 to cease, indicating that the ribbon is nearly exhausted from the feed reel 3. The remaining ribbon can continue to be unreeled from the reel 3, in spite of the blockage of the impeller 7, because it can be pulled past the blocked guide roller 6 by the action of the take-up reel 4.

In place of the mechanical monitoring of the ribbon transport, using the guide mandrel 8, the scanning of the movement of the impeller 7 can also be accomplished directly by means of a scanner responsive to light reflected from the impeller vanes, or passing through the vicinity of the impeller so as to be periodically blocked thereby. When such a modified apparatus is employed, the spring 9 and clip 10 become unnecessary. Scanning devices responsive to a light beam either periodically reflected or periodically blocked by the vanes of the impeller 7 are generally known and therefore need not be described in detail.

It will be apparent that various other modifications and additions may be made in the apparatus of the present invention without departing from the essential features of novelty thereof, which are intended to be defined and secured by the appending claims.

What is claimed is:

1. A monitoring device for monitoring the transport of a strip-like carrier supported on a core-mounted feed reel, said core being displaceable in slots in a cassette housing, said carrier being transported from the feed reel to a take-up reel over a guide roller, and including, in combination; and actuating element secured to said guide roller and extending axially outwardly from said guide roller, a scanning device operatively connected to said actuating element for producing an electrical signal in response to movement of said actuating element, said core moving in said slot toward said actuating element as said carrier is unwound from said feed reel, said core moving into the path of and blocking movement of said actuating element after a predetermined amount of said carrier has been unwound off of said feed reel.

2. Apparatus according to claim 1, wherein said actuating element comprises an impeller.

3. Apparatus according to claim 1, including a sensing mandrel mounted so as to be displaceable relative to said actuating element and spring means urging said mandrel toward said actuating element, said mandrel being adapted to be moved in response to the movement of said actuating element as said guide roller rotates.

4. Apparatus according to claim 3, wherein said scanning device comprises an optical sensor, and a member connected to said mandrel is adapted to selectively enter the light signal path of said optical sensor.

5. Apparatus according to claim 3, wherein said spring means comprises a spring plate mounted on said housing and wherein said sensing mandrel comprises a member attached to said spring plate.

* * * * *